US009290931B2

(12) United States Patent
Grace

(10) Patent No.: US 9,290,931 B2
(45) Date of Patent: Mar. 22, 2016

(54) WALL INSTALLATION SYSTEMS AND METHODS

(71) Applicant: Mark Grace, Alpharetta, GA (US)

(72) Inventor: Mark Grace, Alpharetta, GA (US)

(73) Assignee: EMEH, INC., Lebanon, NJ (US)

( * ) Notice: Subject to any disclaimer, the term of this patent is extended or adjusted under 35 U.S.C. 154(b) by 0 days.

(21) Appl. No.: 14/324,275

(22) Filed: Jul. 7, 2014

(65) Prior Publication Data

US 2016/0002916 A1 Jan. 7, 2016

(51) Int. Cl.

| | |
|---|---|
| ***E04B 1/94*** | (2006.01) |
| ***E04F 13/26*** | (2006.01) |
| ***E04F 13/24*** | (2006.01) |
| ***E04F 13/08*** | (2006.01) |
| ***E04F 13/09*** | (2006.01) |

(52) U.S. Cl.

CPC ..... *E04B 1/948* (2013.01); *E04F 13/0896* (2013.01)

(58) Field of Classification Search

CPC ..... E04D 3/358; E04B 1/948; E04F 13/0896
See application file for complete search history.

(56) References Cited

U.S. PATENT DOCUMENTS 985,140 A * 2/1911 Button ..... E04D 1/28 52/418
1,484,175 A * 2/1924 Elmendorf ..... E04B 1/6175 220/62.11
RE17,143 E * 11/1928 Fischer ..... E04D 1/28 52/420
3,111,787 A * 11/1963 Chamberlain ..... E04D 3/352 156/247
3,121,649 A * 2/1964 Oliver ..... E04D 3/351 156/229
3,307,306 A * 3/1967 Oliver ..... E04B 1/76 52/409
3,468,086 A * 9/1969 Warner ..... E04D 3/355 156/202
3,488,248 A * 1/1970 Long ..... E04D 5/10 156/268
3,708,935 A * 1/1973 Kossuth ..... E04B 2/7457 52/288.1
3,919,443 A * 11/1975 Porter ..... E04F 13/18 428/316.6
3,979,537 A * 9/1976 Troyer ..... B23B 5/24 428/189
4,016,697 A * 4/1977 Ericson ..... B28B 19/0092 52/336
4,071,993 A * 2/1978 Stewart ..... E04D 11/02 52/309.5
4,241,555 A * 12/1980 Dickens ..... E04C 2/205 52/309.4
4,284,447 A * 8/1981 Dickens ..... B29C 33/16 156/299
4,453,358 A * 6/1984 Gruber ..... E04D 3/352 52/309.8

(Continued)

*Primary Examiner* — Rodney Mintz
(74) *Attorney, Agent, or Firm* — Clements Bernard PLLC; Lawrence A. Baratta, Jr.; Christpher L. Bernard

(57) ABSTRACT

A wall installation system and method include providing a first wall panel with tape extending vertically from top to bottom on one side of the first wall panel and on a back of the first wall panel; securing the first wall panel at a site; placing a second wall panel adjacent to the first wall panel; and connecting the tape to the second wall panel to form a fire barrier seal between the first wall panel and the second wall panel.

14 Claims, 9 Drawing Sheets

(56) References Cited

U.S. PATENT DOCUMENTS 4,535,581 A * 8/1985 Fujiki ..... E04D 13/1606 52/520
4,586,308 A * 5/1986 Jennings ..... E04C 2/526 52/393
4,936,070 A * 6/1990 Michaud ..... E04D 3/35 52/40
5,001,879 A * 3/1991 Paliwoda ..... E04C 2/288 52/309.8
5,085,022 A * 2/1992 Paliwoda ..... E04C 2/288 52/309.8
5,236,757 A * 8/1993 Probst ..... B27N 3/04 156/62.2
5,311,717 A * 5/1994 Yount ..... E04B 2/7457 52/417
5,349,796 A * 9/1994 Meyerson ..... E04B 1/14 52/309.11
5,402,615 A * 4/1995 Knott ..... B32B 15/02 428/920
5,687,523 A * 11/1997 Stough ..... B32B 29/02 428/110
5,711,124 A * 1/1998 Stough ..... B32B 29/02 428/343
6,415,573 B1 * 7/2002 Moulder ..... D04H 13/002 442/327
6,820,382 B1 * 11/2004 Chambers ..... E04B 1/948 156/250
7,607,271 B2 * 10/2009 Griffin ..... E04C 2/296 52/478
7,770,346 B2 * 8/2010 Elliott ..... E04C 2/26 52/309.12
7,823,364 B2 * 11/2010 Elliott ..... E04C 2/26 52/309.12
8,959,861 B1 * 2/2015 Wambaugh ..... E04B 1/665 428/189
2001/0029718 A1 * 10/2001 Snyder ..... E04B 1/941 52/474
2003/0074851 A1 * 4/2003 Charmat ..... B29C 63/02 52/393
2004/0226247 A1 * 11/2004 Byrd ..... E04D 3/35 52/518
2005/0144850 A1 * 7/2005 Hageman ..... E04D 3/358 52/3
2006/0096213 A1 * 5/2006 Griffin ..... E04C 2/296 52/409
2007/0044407 A1 * 3/2007 Elliott ..... E04C 2/26 52/483.1
2007/0125042 A1 * 6/2007 Hughes ..... B32B 5/18 52/782.1
2007/0272320 A1 * 11/2007 Roberson ..... F16L 59/021 138/149
2008/0168728 A1 * 7/2008 Scherrer ..... E04B 1/7608 52/309.11
2009/0004459 A1 * 1/2009 Kipp ..... C04B 28/26 428/318.4
2009/0239059 A1 * 9/2009 Kipp ..... C04B 28/26 428/323
2009/0239429 A1 * 9/2009 Kipp ..... C04B 28/26 442/1
2010/0175322 A1 * 7/2010 Lee ..... E06B 3/5892 49/70
2010/0192510 A1 * 8/2010 Elliott ..... E04C 2/26 52/741.3
2011/0179740 A1 * 7/2011 Padmanabhan .... B62D 25/2054 52/588.1
2011/0239573 A1 * 10/2011 Lockhart ..... E04B 2/7412 52/404.1
2011/0252728 A1 * 10/2011 Scherrer ..... E04B 1/80 52/220.1
2012/0088050 A1 * 4/2012 Lavature ..... B32B 5/028 428/41.1
2013/0196136 A1 * 8/2013 Contzen ..... B32B 27/08 428/221
2014/0215937 A1 * 8/2014 Zhou ..... D06N 5/00 52/173.1
2014/0345223 A1 * 11/2014 Miks ..... E04C 2/46 52/309.4
2015/0367603 A1 * 12/2015 Guandalini ..... B32B 5/245 428/319.1

* cited by examiner

WALL INSTALLATION SYSTEMS AND METHODS

FIELD OF THE DISCLOSURE

The present disclosure relates generally to wall installation. More particularly, the present disclosure relates to improved wall installation systems and methods.

BACKGROUND OF THE DISCLOSURE

In conventional wall installations, e.g. dry wall, the process can be lengthy. This can be especially problematic in a commercial setting where such installations can require shutting down a location due to fire code regulations, etc. For example, installing traditional dry wall includes screwing to studs, taping seams between dry wall sections, taping the seams, mudding the seams, letting the mudding dry, sanding the mudding to smooth it, sealing it with a solvent-based paint, and finally painting the dry wall. Further, if there is a fix, change, or addition to the wall in the future, the location or part of the location has to be shut down while the installations are performed. Additionally, paints and glues can cause odors or other undesirable effects in the location on-site. Lastly, dry wall is ideal due to its cost as compared to particle board, plastic, etc. Also, the wall has to pass three hour fire code testing, which dry wall does, and particle board, plastic, etc. may not pass without expensive treatments or additions.

BRIEF SUMMARY OF THE DISCLOSURE

In an exemplary embodiment, an improved wall installation method includes providing a first wall panel with tape extending vertically from top to bottom on one side of the first wall panel and on a back of the first wall panel; securing the first wall panel at a site; placing a second wall panel adjacent to the first wall panel; and connecting the tape to the second wall panel to form a fire barrier seal between the first wall panel and the second wall panel. The improved wall installation method can further include attaching a protective coating to the first wall panel prior to providing the first wall panel at the site. The improved wall installation method can further include painting the first wall panel prior to providing the first wall panel at the site. The first wall panel and the second wall panel can include drywall that is reverse installed with the tape on the back facing studs. The improved wall installation method can further include inserting a trim between the first wall panel and the second wall panel at the fire barrier seal, wherein the trim does not extend to the tape. The improved wall installation method can further include performing the improved wall installation method at a commercial location in a section of the site, wherein the commercial location remains open during the improved wall installation method. The improved wall installation method can further include securing the first wall panel at the site without putting holes in the first wall panel which penetrate the first wall panel creating a failure of a fire wall and require on-site mudding. The improved wall installation method can further include securing the first wall panel at the site with "J" rails located at or near a ceiling and a floor. The improved wall installation method can further include securing the first wall panel at the site with a "J" rail located at or near a ceiling and one or more attachment clamps. The tape can include fire tape and about half of a width of the fire tape is affixed to the first wall panel and about another half of the width of the fire tape includes a peel off label that is removed prior to the placing of the second wall panel.

In another exemplary embodiment, an improved wall installation system includes a first wall panel including a left side and a right side with fire tape affixed to at least one of the left side and the right side vertically from top to bottom, wherein the fire tape is affixed on a back side of the first wall panel; a second wall panel including a left side and a right side configured to affix to the fire tape from the first wall panel to form a fire wall barrier once the second wall panel is placed adjacent to the first wall panel; and a securing mechanism to secure the first wall panel and the second wall panel without putting holes in the first wall panel or the second wall panel which penetrate and create a failure of a fire wall and require on-site mudding. The improved wall installation system can further include a protective coating applied or attached to the first wall panel and the second wall panel prior to providing the first wall panel and the second wall panel on-site. The improved wall installation system can further include paint applied to the first wall panel and the second wall panel prior to providing the first wall panel and the second wall panel on-site. The first wall panel and the second wall panel can include drywall that is reverse installed with the fire tape on the back facing studs. The improved wall installation system can further include a trim insertable between the first wall panel and the second wall panel at the fire wall barrier, wherein the trim does not extend to the fire tape. The first wall panel and the second wall panel can be installed at a commercial location in a section of a site, wherein the commercial location remains open during installation. The securing mechanism can include "J" rails located at or near a ceiling and a floor. The securing mechanism can include a "J" rail located at or near a ceiling and one or more attachment clamps. About half of a width of the fire tape is affixed to the first wall panel and about another half of the width of the fire tape includes a peel off label that is removed prior to the placing of the second wall panel.

In yet another exemplary embodiment, a drywall panel includes a front, a back, a left side, and a right side; fire tape affixed vertically from top to bottom on at least one of the left side and the right side, wherein the fire tape is affixed on the back for a reverse installation with another drywall panel; and a coating applied or affixed to the front prior to the drywall panel being sent on-site.

BRIEF DESCRIPTION OF THE DRAWINGS

The present disclosure is illustrated and described herein with reference to the various drawings, in which like reference numbers are used to denote like system components/method steps, as appropriate, and in which.

DETAILED DESCRIPTION OF THE DISCLOSURE

In various exemplary embodiments, improved wall installation systems and methods are described. The wall installation systems and methods have specific applicability in commercial constructions and include the following:

1) Reduces time on-site for putting up walls;
2) Satisfies regulatory compliance in quick fashion to avoid closing in commercial locations;
3) Avoids on-site sealing, mudding, and/or painting; and
4) Maintains low-cost through use of drywall or the like.

In an exemplary embodiment, an improved wall installation method includes providing a first wall panel with tape extending vertically from top to bottom on one side of the first wall panel and on a back of the first wall panel; securing the first wall panel at a site; placing a second wall panel adjacent to the first wall panel; and connecting the tape to the second wall panel to form a fire barrier seal between the first wall panel and the second wall panel.

In another exemplary embodiment, an improved wall installation system includes a first wall panel including a left side and a right side with fire tape affixed to at least one of the left side and the right side vertically from top to bottom, wherein the fire tape is affixed on a back side of the first wall panel; a second wall panel including a left side and a right side configured to affix to the fire tape from the first wall panel to form a fire wall barrier once the second wall panel is placed adjacent to the first wall panel; and a securing mechanism to secure the first wall panel and the second wall panel without putting holes in the first wall panel or the second wall panel which penetrate and create a failure of a fire wall and require on-site mudding.

In yet another exemplary embodiment, a drywall panel includes a front, a back, a left side, and a right side; fire tape affixed vertically from top to bottom on at least one of the left side and the right side, wherein the fire tape is affixed on the back for a reverse installation with another drywall panel; and a coating applied or affixed to the front prior to the drywall panel being sent on-site.

Figure 1:
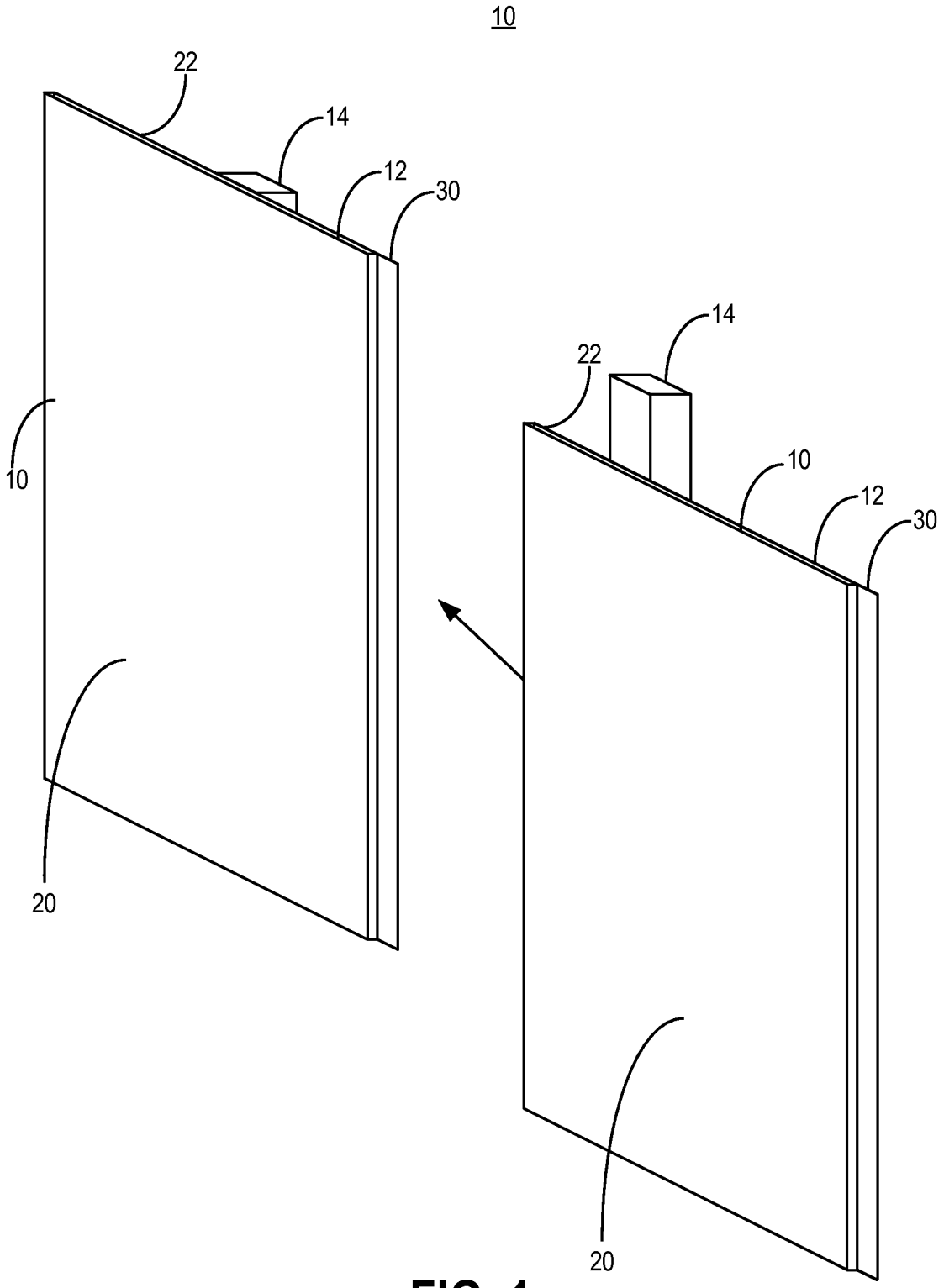
FIG. 1 is a perspective diagram of two wall panels one of which is attached to a stud in an improved wall installation system.
Figure 2:
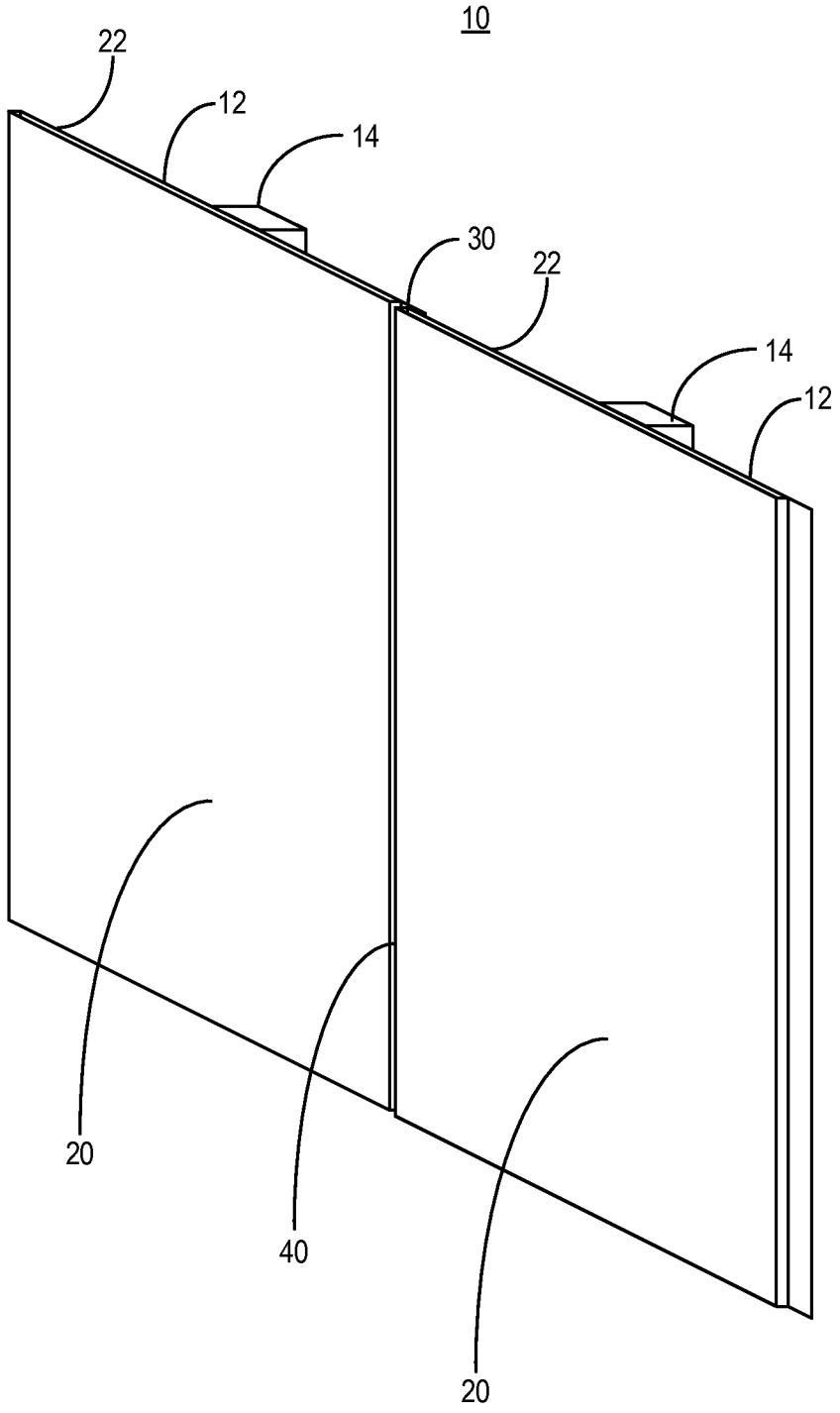
FIG. 2 is a perspective diagram of the two wall panels from FIG. 1 both attached to the studs.
Figure 3:
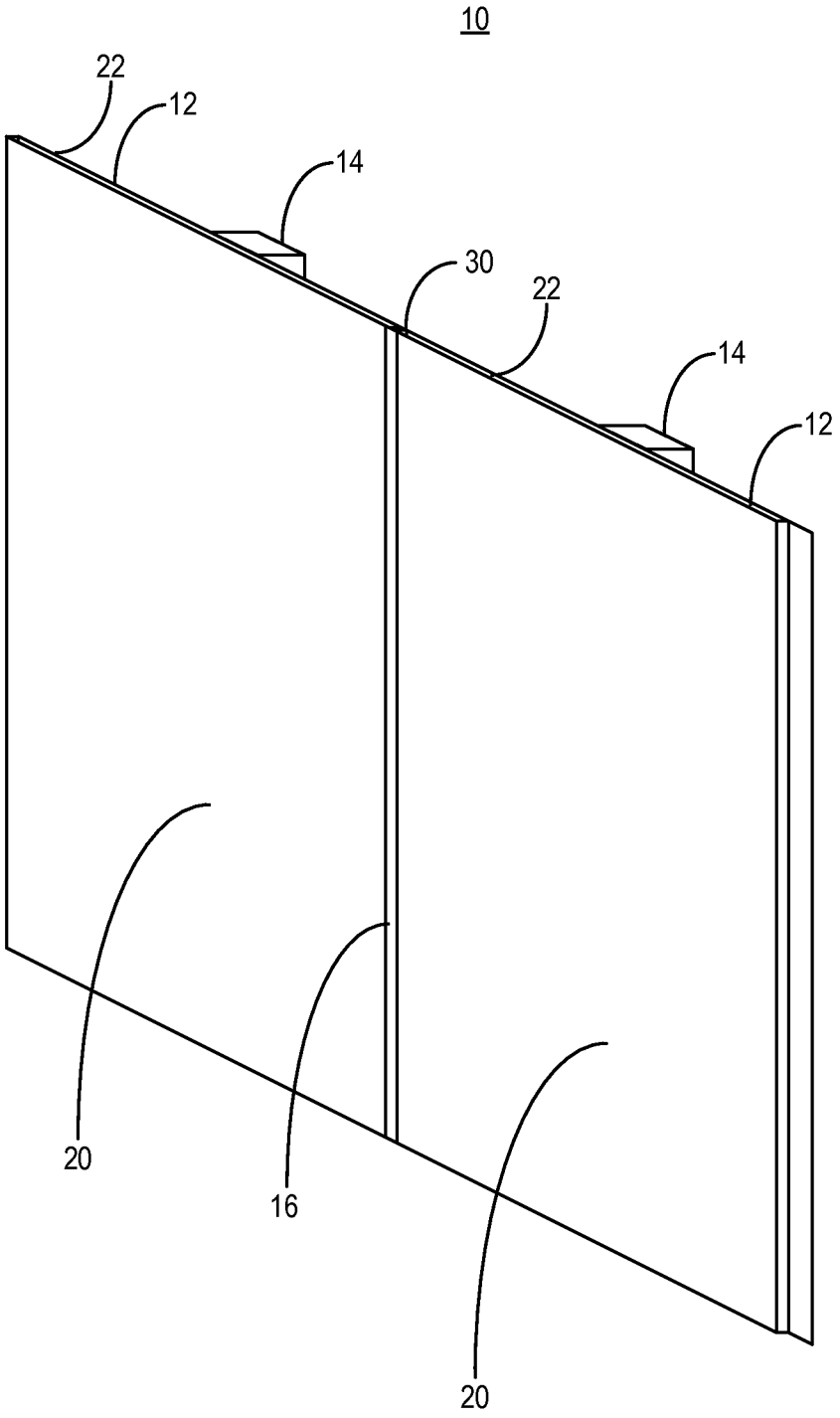
FIG. 3 is a perspective diagram of the two wall panels from FIGS. 1-2 both attached to the studs with an insert trim between the two wall panels.
Figure 4:
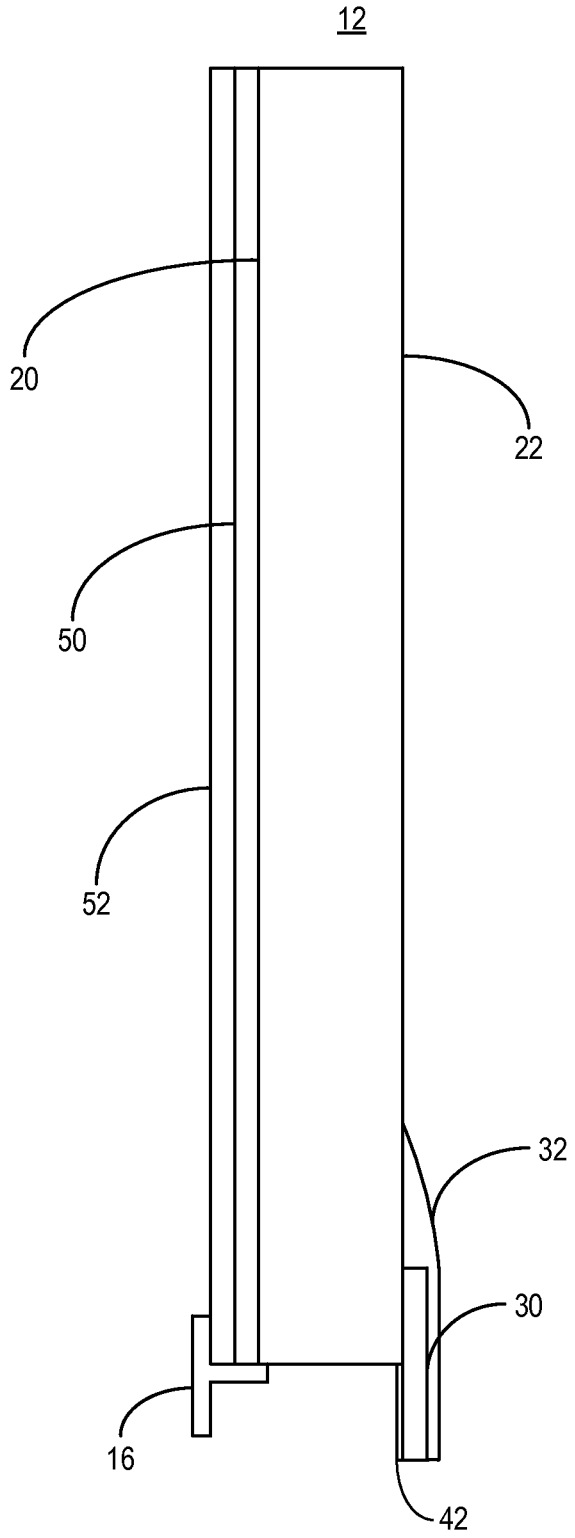
FIG. 4 is a cross sectional diagram of the wall panel.

Referring to FIGS. 1-4, in various exemplary embodiments, various diagrams illustrate an improved wall installation system 10. FIG. 1 is a perspective diagram of two wall panels 12 one of which is attached to a stud 14. FIG. 2 is a perspective diagram of the two wall panels 12 from FIG. 1 both attached to the studs 14. FIG. 3 is a perspective diagram of the two wall panels 12 from FIGS. 1-2 both attached to the studs 14 with an insert trim 16 between the two wall panels 12. FIG. 4 is a cross sectional diagram of the wall panel 12.

The wall panel 12 can be drywall (also known as plasterboard, wallboard, gypsum board, or LAGYP), plastic, wood, etc. Drywall is a panel made of gypsum plaster pressed between two thick sheets of paper. It is used to make interior walls and ceilings. Drywall is typically used due to low cost, speed of installation, and fire compliance. The wall panel 12 includes a front side 20 and a back side 22.

Again, conventionally, the wall panels 12 are attached to the studs 14 such as through nails or screws, tape is placed between the wall panels 12 at the seam where they meet, mudding is placed over the tape, dried and sanded, and finally the wall panels 12 are painted. The problems include the lack of regulatory compliance due to the holes from the nails or screws and until the tape is up, the on-site effort in taping, mudding, sanding, painting, etc., and the like. This can lead to closing down stores or sections of stores while construction is ongoing.

To alleviate the aforementioned limitations, the improved wall installation system 10 proposes a "reverse installation." That is, the wall panels 12 are installed from the rear with tape 30 and preferably mounted to the studs 14 or the like without putting holes in the front side 20. Additionally, to avoid on-site painting, sealing, etc., the front side 20 can be prepared with paint, sealings, covers, etc. prior to arrival on-site.

To preserve a fire protection barrier, before attaching the wall panels 12 to the studs 14, a fire tape 30 (and optionally mudding 32, to the back of the wall panels 12 (facing the studs 14), leaving overlap, such as when the next wall panel 12 is installed next to it, it connects to the tape 30 and the mudding 32 to create a seal 40 between the two wall panels 12, so that the wall installation system 10 passes a fire test (will not pass test if there is a crack between the wall sections because the smoke and flames could go through that crack and spread). This meets all the requirements of commercial customers such as retailers.

The fire tape 30 can be a fire barrier tape like intumescent tape and it could have fire caulk spread on it (on the stud side) optionally. The fire tape 30 can be anything that can be affixed to the first wall panel 12 on the rear side, and then affixed to an adjacent wall panel 12 on the rear in the field, on-site.

Specifically, FIG. 1 illustrates the wall installation system 10 with one of the wall panels 12 attached to the stud 14 and with the tape 30 on the back side 22 of the wall panel 12. Note, the tape 30 can be attached to the back side 22 prior to arrival on-site, such as in a manufacturing facility. Half of the tape 30 can be affixed to the back side 22 with the other half including a peel away layer 42 that can be removed on-site when the second wall panel 12 is installed.

FIG. 2 illustrates the wall installation system 10 with both of the wall panels 12 attached to the studs 14 and connected together on their respective back sides 22 with the tape 30. Note, once placed and secured with the tape 30, the wall panels 12 form a compliant fire barrier. FIG. 3 illustrates the wall installation system 10 from FIG. 2 with the insert trim 16 included in the seal 40. The insert trim 16 is used to obscure the seal 40 on the front side 20 for aesthetic purposes and to avoid having to tape, mud, seal, paint, etc. the front side 20 on-site. Note, the insert trim 16 does not extend to the tape 30 to avoid puncturing the tape 30 and breaking the first barrier.

FIG. 4 is a cross-sectional view of the wall panel 12. This illustrates the tape 30 half affixed to the back side 22 along with the peel away layer 42 on the other half. The mudding 32 is also shown over the tape 30. On the front side 20, the insert trim 16 is illustrated and is shown to not extend to the tape 30. The insert trim 16 can be any joint treatment, architectural piece, or the like. On the front side 20, i.e. the customer facing side, the wall panel 12 can include a protection layer 50 and/or a wall covering 52. Of course, the protection layer 50 and the wall covering 52 can be integrated in a single layer.

Of note, the protection layer 50 and/or a wall covering 52 is installed prior to the wall panel 12 being on-site such as in the factory or manufacturing facility. The protection layer 50 and/or the wall covering 52 can be a film covering, paint, etc. Also, the protection layer 50 and/or the wall covering 52 can be different colors, textures, patterns, prints, etc. as required by the end user. Importantly, the protection layer 50 and/or the wall covering 52 is installed off-site thereby avoiding the need for paint, sealing, etc. on-site. The protection layer 50 and/or the wall covering 52 can include a protective coating, a textured coating like metal or wood or any architectural coating.

Figure 5:
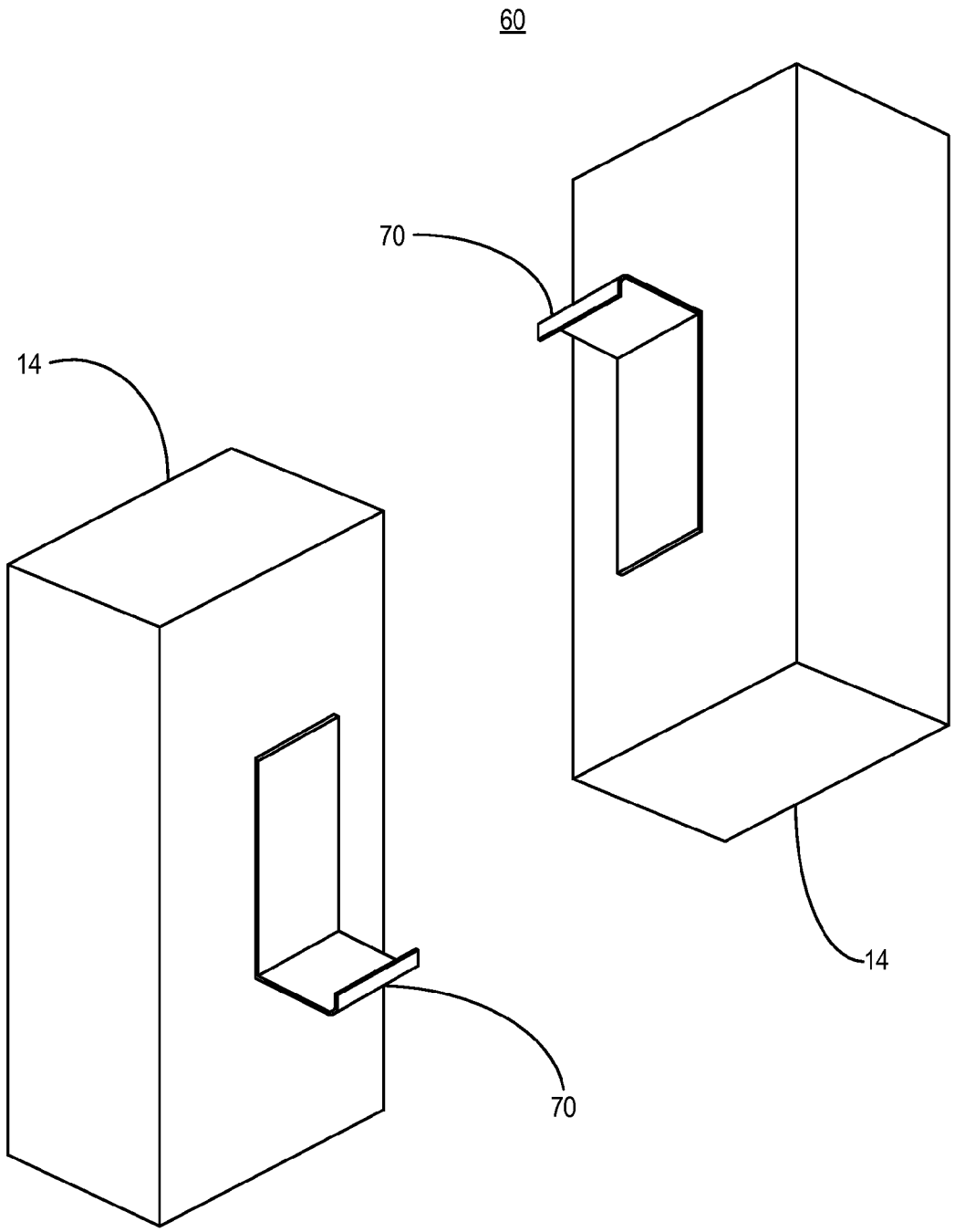
FIG. 5 illustrates a perspective diagram of a "J" rail connection mechanism.
Figure 6:
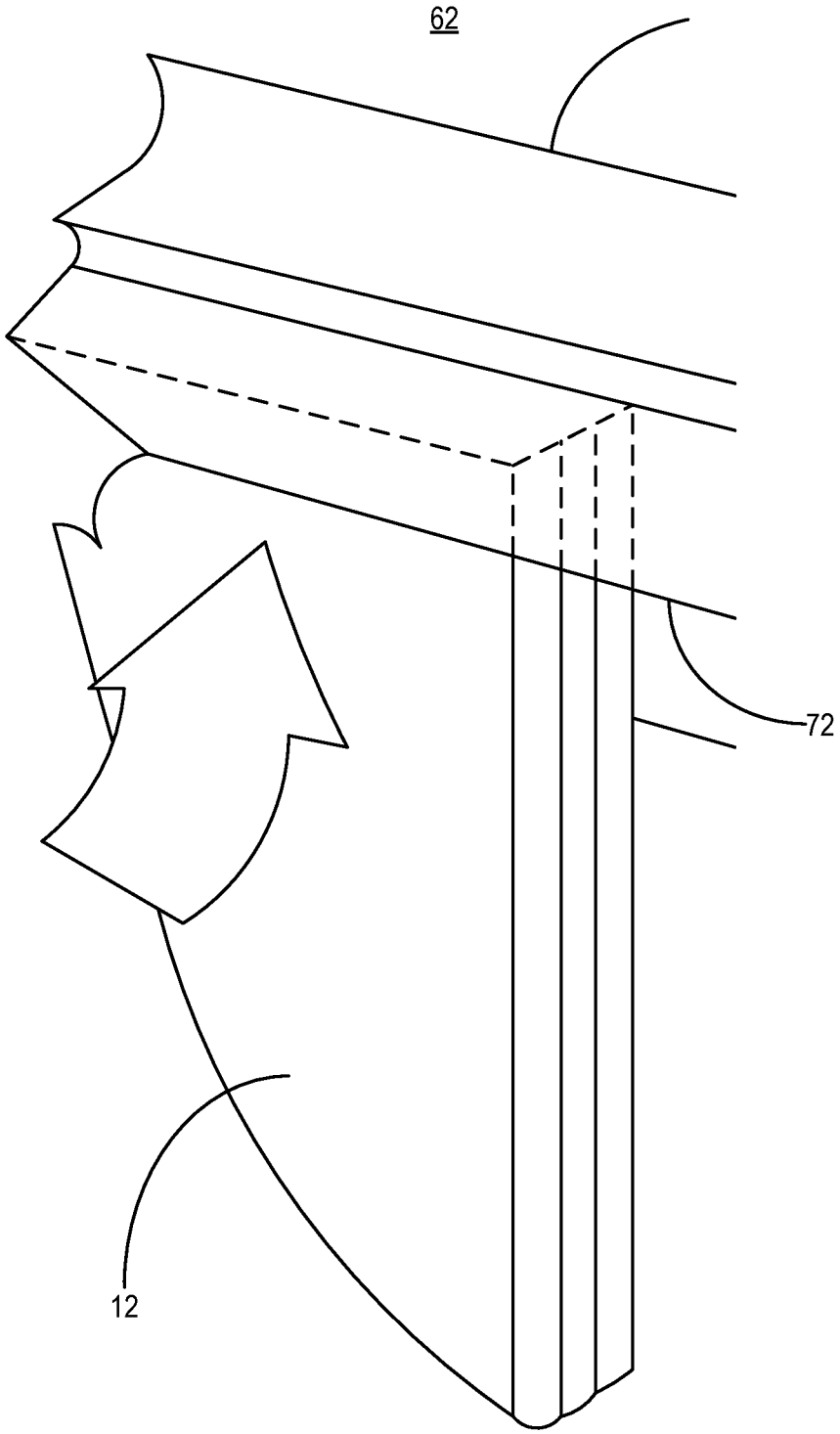
FIG. 6 illustrates a perspective diagram of a another "J" rail connection mechanism.
Figure 7:
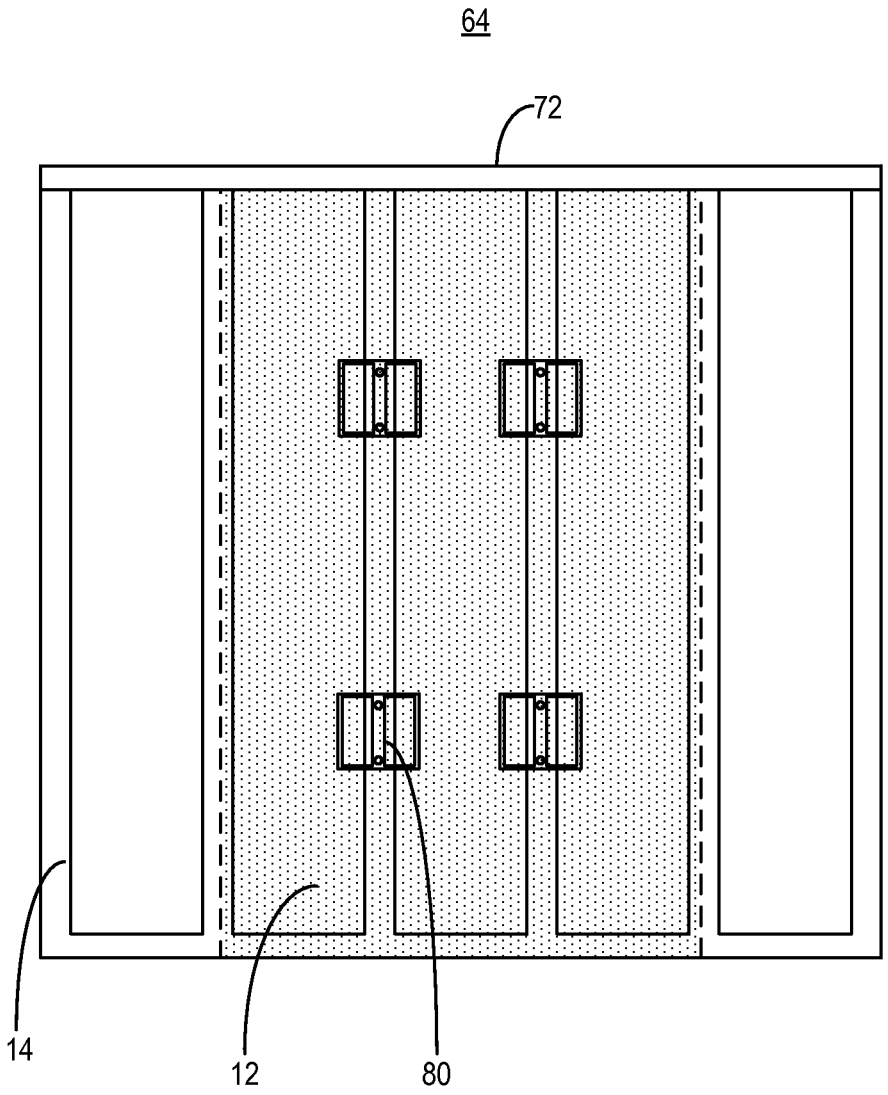
FIGS. 7-8 illustrate perspective diagrams of a connection mechanism.
Figure 8:
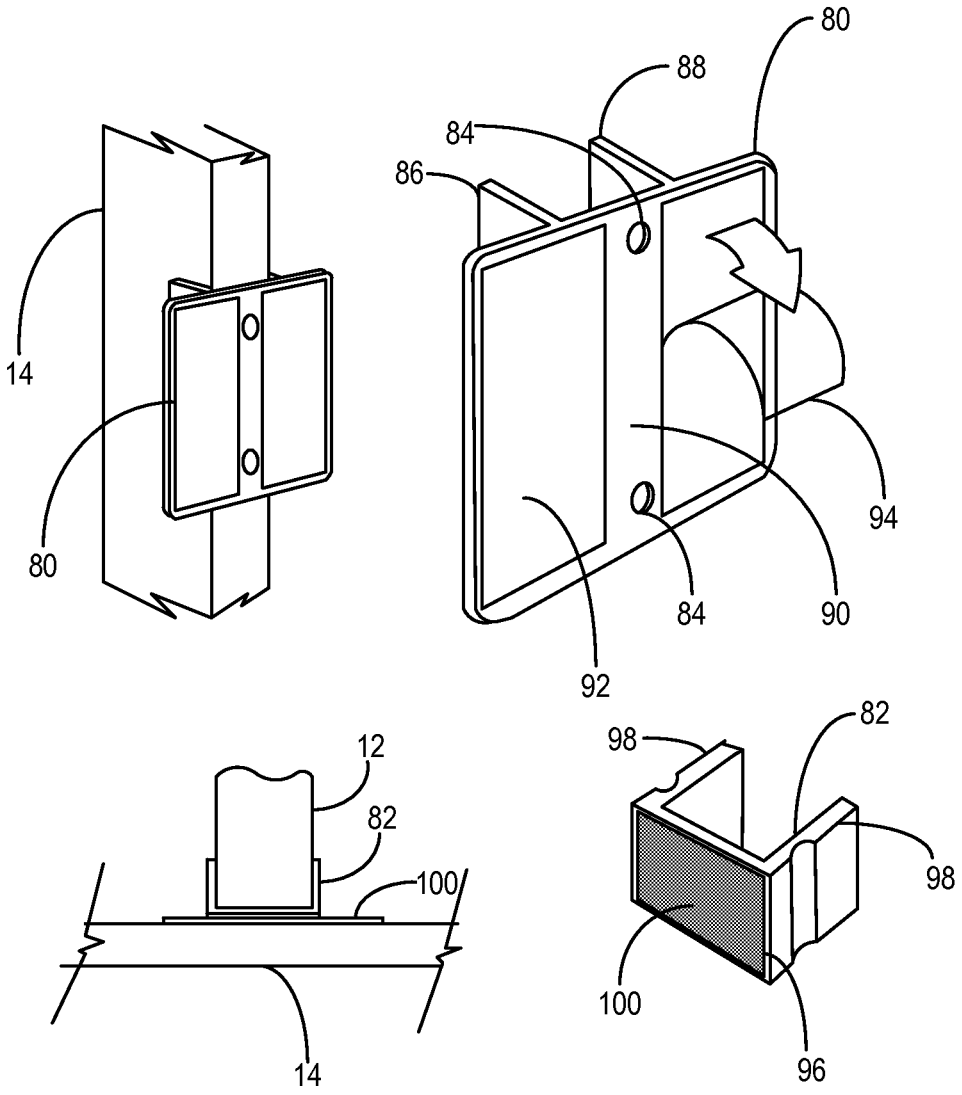

Referring to FIGS. 5-8, in various exemplary embodiments, various diagrams illustrate various attachment mechanisms for connecting the wall panels 12 to the studs 14, etc. in the improved wall installation system 10. FIG. 5 illustrates a perspective diagram of a "J" rail connection mechanism 60. FIG. 6 illustrates a perspective diagram of another "J" rail connection mechanism 62. FIGS. 7-8 illustrate perspective diagrams of a connection mechanism 64.

Each of the mechanisms 60, 62, 64 add an ability to attach the wall panels 12 without using screws or nails (which would penetrate the wall panels 12 (and the crack) and cause 1) failure of the fire wall, 2) require mudding of the screw holes which advantageous to avoid on-site, and 3) could avoid using glues on-site.

FIG. 5 illustrates the "J" rail connection mechanism 60, i.e. "J" rails. Here, "J" rail hooks 70 are attached to the studs 14. The "J" rail hooks 70 are attachment clamps in which the wall panels 12 slidingly engage. A "J" rail hook 70 is placed towards a bottom of the stud 14 near the floor and another is placed towards a top of the stud 14 near a ceiling. FIG. 6 illustrates the "J" rail connection mechanism 62. Here, a railing 72 is attached near a ceiling and optionally another railing 72 (not shown) is attached near a floor. The "J" rails can be J trim and any other type of easy connection.

FIG. 7-8 the connection mechanism 64 which can be used with the "J" rail connection mechanisms 60, 62. In FIG. 7, for example, the "J" rail connection mechanisms 60, 62 can include a single hook 70 or railing 72 at the ceiling along with the connection mechanism 64 on the studs 14. Here, the wall panels 12 are slid into the railing 72 and are taped or the like to attachment clamps 80.

FIG. 8 illustrates various aspects of the attachment clamps 80 and an attachment rail 82. The attachment clamps 80 can be screwed or nailed to the studs 14 through holes 84. The attachment clamps 80 includes sides 86, 88 which engage and are supported by the studs 14. The sides 86, 88 are attached or disposed to a front side 90 which includes an adhesive 92 that can be covered by a peel away layer 94. The attachment clamps 80 are placed on certain studs 14 and the peel away layer 94 is removed prior to placing the wall panel on the attachment clamps 80. Collectively, the attachment clamps 80 and the railing 72 can support the wall panels 12 without having to nail or drill through the wall panels 12. The adhesive 92 can be tape, glue, magnets, Velcro, etc.

The attachment rail 82 can be used to hold the wall panel to a perpendicular stud 14 (or at an angle). The attachment rail 82 includes a back 96 which connects to two sides 98. The sides 98 slidingly engage the wall panel 12 for support. The back 96 is connected to the perpendicular stud 14. The attachment rail 82 can be screwed or nailed into the perpendicular stud 14. Alternatively, the attachment rail 82 can include an adhesive 100 to connect to the perpendicular stud 14. The adhesive 100 can be tape, glue, magnets, Velcro, etc. For connection at an angle, the sides 98 are angled accordingly relative to the back 96.

Figure 9:
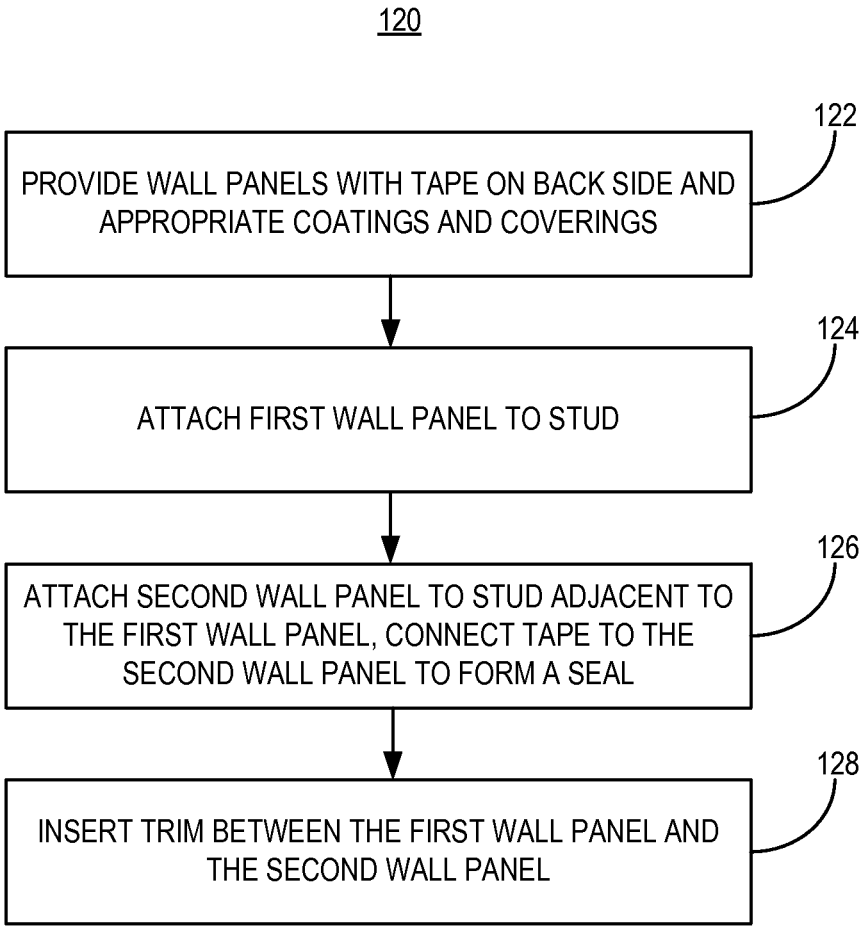
FIG. 9 is a flowchart of an improved wall installation method.

Referring to FIG. 9, in an exemplary embodiment, a flowchart illustrates an improved wall installation method 120. The improved wall installation method 120 includes providing wall panels with tape on a back side and appropriate coatings and coverings (step 122), attaching a first wall panel to a stud (step 124), attaching a second wall panel to stud adjacent to the first wall panel and connecting tape to the second wall panel to form a seal (step 126), and optionally, inserting trim between the first wall panel and the second wall panel (step 128).

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

What is claimed is:

1. A wall installation method, comprising:

providing a first wall panel with tape extending vertically from top to bottom on one side of the first wall panel, wherein the tape is on a back of the first wall panel and a portion of the tape extends past the one side leaving an overlap for connection to a back side of a second wall panel;

securing the first wall panel at a site;

placing the second wall panel adjacent to the first wall panel; and connecting the tape to the second wall panel to form a fire barrier seal between the first wall panel and the second wall panel, wherein the tape comprises fire tape and about half of a width of the fire tape is affixed to the first wall panel and the overlap portion of the width of the fire tape comprises a peel off label that is removed prior to the placing of the second wall panel.

2. The wall installation method of claim 1, further comprising:

attaching a coating to the first wall panel prior to providing the first wall panel at the site, the coating comprises a protective coating, a textured coating, or any architectural coating.

3. The wall installation method of claim 1, further comprising:

painting the first wall panel prior to providing the first wall panel at the site.

4. The wall installation method of claim 1, wherein the first wall panel and the second wall panel comprise drywall that is reverse installed with the tape on the back facing studs.

5. The wall installation method of claim 1, further comprising:

inserting a trim between the first wall panel and the second wall panel at the fire barrier seal, wherein the trim does not extend to the tape.

6. The wall installation method of claim 1, further comprising:

performing the wall installation method at a commercial location in a section of the site, wherein the commercial location remains open during the wall installation method.

7. The wall installation method of claim 1, wherein the first wall panel and the second wall panel pass a fire test subsequent to the connecting.

8. The wall installation method of claim 1, wherein the tape is attached to the first wall panel prior to arrival on-site and the connecting to the second wall panel is performed on-site.

9. The wall installation method of claim 1, wherein, subsequent to the connecting, the first wall panel and the second wall panel form a fire barrier.

10. The wall installation method of claim 1, further comprising:

installing at least one of a protection layer and a wall covering to the first wall panel and the second wall panel.

11. The wall installation method of claim 1, wherein the installing is performed prior to the first wall panel and the second wall panel being on-site.

12. The wall installation method of claim 1, further comprising:

securing the first wall panel at the site without putting holes in the first wall panel which penetrate the first wall panel creating a failure of a fire wall and require on-site mudding.

13. The wall installation method of claim 12, further comprising:

securing the first wall panel at the site with "J" rails located at or near a ceiling and a floor.

14. The wall installation method of claim 12, further comprising:

securing the first wall panel at the site with a "J" rail located at or near a ceiling and one or more attachment clamps.

* * * * *